US009441398B2

(12) United States Patent
Adolfsson

(10) Patent No.: US 9,441,398 B2
(45) Date of Patent: Sep. 13, 2016

(54) ARRANGEMENT FOR A LOCK

(76) Inventor: Bernt Adolfsson, Ljungby (SE)

( * ) Notice: Subject to any disclaimer, the term of this patent is extended or adjusted under 35 U.S.C. 154(b) by 674 days.

(21) Appl. No.: 13/809,668

(22) PCT Filed: Jul. 14, 2011

(86) PCT No.: PCT/SE2011/050951

§ 371 (c)(1),
(2), (4) Date: Jan. 11, 2013

(87) PCT Pub. No.: WO2012/008914

PCT Pub. Date: Jan. 19, 2012

(65) Prior Publication Data

US 2013/0104610 A1 May 2, 2013

(30) Foreign Application Priority Data

Jul. 16, 2010 (SE) ..... 1050810

(51) Int. Cl.

| | |
|---|---|
| ***E05B 29/04*** | (2006.01) |
| ***E05B 29/00*** | (2006.01) |
| ***E05B 19/18*** | (2006.01) |
| ***E05B 47/00*** | (2006.01) |

(52) U.S. Cl.

CPC ..... *E05B 29/0033* (2013.01); *E05B 19/18* (2013.01); *E05B 29/00* (2013.01); *E05B 47/0044* (2013.01); *Y10T 70/7599* (2015.04)

(58) Field of Classification Search

CPC .... E05B 29/0033; E05B 19/18; E05B 29/00; E05B 47/0044; E05B 29/004; Y10T 70/7599; Y10T 70/7729; Y10T 70/774; Y10T 70/7746; Y10T 70/7695; Y10T 70/7565

USPC ..... 70/492, 409, 377, 495, 376, 392, 384, 70/382, 385, 419, DIG. 37, 358

See application file for complete search history.

(56) References Cited

U.S. PATENT DOCUMENTS 1,107,376 A * 8/1914 Thiman ..... 70/492
1,406,573 A * 2/1922 Mantanfel ..... 70/492

(Continued)

FOREIGN PATENT DOCUMENTS

| | | | |
|---|---|---|---|
| DE | 20311099 U1 | | 10/2003 |
| GB | 2041061 | * | 9/1980 |
| SE | 533347 C2 | | 8/2010 |

OTHER PUBLICATIONS

International Search Report for PCT/SE2011/050951, mailed Oct. 27, 2011; ISA/SE.

*Primary Examiner* — Lloyd Gall
(74) *Attorney, Agent, or Firm* — Harness, Dickey & Pierce, PLC

(57) ABSTRACT

A lock includes a first lock part and a second lock part which is rotatably arranged in the first lock part and includes a plurality of lock elements for cooperation with the first lock part and a key. First and second groups of lock elements have a first position relative to the second lock part absent actuation of the key and are moved from the first position into a third position via a second intermediate position, and to prevent rotation of the second lock part in a first position. The lock elements in the first group are arranged to prevent rotation of the second lock part from a second position and, in the third position, allow rotation of the second lock part. Likewise, each lock element in the second group allow rotation of the second lock part and, in the third position, prevent rotation of the second lock part.

17 Claims, 8 Drawing Sheets

(56) References Cited

U.S. PATENT DOCUMENTS

| | | | | | |
|---|---|---|---|---|---|
| 1,440,459 | A | * | 1/1923 | Greff | 70/342 |
| 1,644,365 | A | * | 10/1927 | Bennett | 70/492 |
| RE20,143 | E | * | 10/1936 | Gray | 70/492 |
| 2,647,391 | A | * | 8/1953 | Uher | 70/492 |
| 3,170,317 | A | * | 2/1965 | Parlier | 70/492 |
| 3,208,248 | A | * | 9/1965 | Tornoe | 70/383 |
| 4,292,823 | A | * | 10/1981 | Reinhard et al. | 70/492 |
| 4,440,008 | A | * | 4/1984 | Uher | 70/492 |
| 5,134,871 | A | * | 8/1992 | Makino et al. | 70/492 |
| 6,263,713 | B1 | * | 7/2001 | Fantl | 70/492 |
| 2005/0061042 | A1 | | 3/2005 | Lin | |
| 2006/0101880 | A1 | * | 5/2006 | Ward-Dolkas et al. | 70/492 |

* cited by examiner

ARRANGEMENT FOR A LOCK

CROSS-REFERENCE TO RELATED APPLICATIONS

This application is a 371 U.S. National Stage of International Application No. PCT/SE 2011/050951, filed on Jul. 14, 2011, which claims priority to Swedish Patent Application No. 1050810-9, filed on Jul. 16, 2010. The contents of the above applications are incorporated herein by reference in their entirety.

TECHNICAL FIELD

The present inventive concept relates to an arrangement for a lock.

PRIOR ART

Traditional locks are usually made up of a cylinder rotatably arranged in a cylinder housing and comprising a plurality of lock elements of different design. For rotation of the cylinder to be allowed, each lock element must be actuated with a key in the intended manner. In order to enable a large number of opening criteria or lock codes, the cylinder contains many lock elements with many different configurations, which lock elements thus need to be actuated in many different ways to allow rotation of the cylinder. This traditional lock type normally has a fixed configuration which is defined in the factory when the lock is produced. Since locks, for obvious reasons, are variously designed, it is thus difficult to mass produce such locks in a rational and cost-effective manner.

SUMMARY OF THE INVENTION

An object of the present inventive concept is thus to provide an arrangement for a lock which enables rational and cost-effective production of locks.

According to a first aspect of the inventive concept, an arrangement for a lock is provided, comprising a first lock part and a second lock part which is rotatably arranged in the first lock part and comprises a plurality of lock elements for cooperation with the first lock part and a key, which lock elements comprise a first and a second group of lock elements which are oriented with a primary end facing in a first and a second direction respectively relative to the second lock part, each of which lock elements in the first and the second group is arranged: to assume a first position relative to the second lock part in the absence of actuation of the key, to be movable by means of the key from the first position into a third position via a second position which is an intermediate position relative to the first and the third position, and to prevent rotation of the second lock part in the first position, each lock element in the first group being arranged to in the second position prevent rotation of the second lock part and in the third position allow rotation of the second lock part, and each lock element in the second group being arranged to in the second position allow rotation of the second lock part and in the third position prevent rotation of the second lock part.

The arrangement according to the invention enables a secure lock of simple structure. Since the lock elements in both the first and the second group prevent rotation when they are in their first positions, a strong construction is obtained, which construction makes rotation of the second lock part difficult without access to the correct key.

The fact that each lock element in the first group prevents rotation of the second lock part when the respective lock element is in its second position and allows rotation in its third position, combined with the fact that each lock element in the second group allows rotation of the second lock part when the respective lock element is in its second position and prevents rotation in its third position, means that a large number of lock codes can be obtained with just two groups or types of lock element. This, in turn, enables rational and cost-effective production of the arrangement. Furthermore, the arrangement enables the establishment of a binary opening condition or binary lock code, wherein the number of possible codes for an arrangement comprising N number of lock elements amounts to $2^N$.

The second lock part may be rotatably arranged in the first lock part from an initial orientation relative to the first lock part wherein, when the second lock part is in the initial orientation, each lock element in the first and the second group is arranged: to assume the first position, to be movable, and to prevent rotation of the second lock part from the initial orientation.

According to one embodiment, each lock element in the first group and the second group is reconfigurable into a lock element in the second group and the first group respectively by such reorientation of the lock element that the primary end thereof is turned in the second and first direction respectively.

According to this embodiment, an arrangement for a lock is provided, which arrangement can be conveniently and easily provided with a code or an opening condition by arranging each lock element with its primary end facing in the first direction or the second direction. This enables effective production, since only lock elements of one configuration need to be produced. This embodiment additionally allows an existing lock to be recoded. This can be useful, for example, if the key has been lost, since the lock code can then easily be changed so that the lost key becomes unusable.

According to one embodiment, the first lock part comprises a first and a second receiving means, the lock elements being arranged to cooperate with the receiving means. The receiving means may extend in a direction parallel with the longitudinal direction of the second lock part. The lock elements may be arranged to cooperate with said receiving means when the second lock part is in the initial orientation.

According to one embodiment, the arrangement is arranged such that the primary end of each lock element in the first group engages with the first receiving means when the said lock element is in the first position and when the said lock element is in the second position, wherein rotation of the second lock part is prevented. The fact that the primary end of a lock element in the first group engages with the first receiving means when the lock element is in the first position and when the lock element is in the second position means that rotation of the second lock part relative to the first lock part is effectively prevented.

The arrangement may further be arranged such that the primary end of each lock element in the first group, upon displacement of the lock element from the second position into the third position, is disengaged from the first receiving means, wherein rotation of the second lock part is allowed. An element in the first group will thus effectively prevent rotation of the second lock part when the element is in its first and second position, but allow rotation when it is in its third position.

According to one embodiment, each lock element in the second group presents a secondary end, the arrangement being arranged such that the secondary end engages with the first receiving means when the lock element is in the first position, wherein rotation of the second lock part is prevented. The fact that the secondary end of a lock element in the second group engages with the first receiving means when the lock element is in the first position means that rotation of the second lock part can be effectively prevented.

The arrangement may further be arranged such that the secondary end of each lock element in the second group, upon displacement of the lock element from the first position into the second position, is disengaged from the first receiving means, wherein rotation of the second lock part is allowed. Such a lock element, when in its second position, will thus not prevent rotation of the second lock part.

The arrangement may further be arranged such that the primary end of the lock element in the second group, upon displacement of the lock element from the second position into the third position, is brought into engagement with the second receiving means, wherein rotation of the second lock part is prevented. In order to be able to rotate the second lock part, it is thus not sufficient for the lock element to be displaced from the first to the second position so that the secondary end disengages from the first receiving means, but nor may it be displaced such that its primary end is brought into engagement with the second receiving means. This design makes forcing of the arrangement difficult.

According to one embodiment, each lock element in the first group presents a secondary end and is arranged to be movable from the third position into a fourth position when the second lock part is in the initial orientation, the arrangement being arranged such that the secondary end of each lock element in the first group, upon displacement of the lock element from the third position into the fourth position, is brought into engagement with the second receiving means, whereby rotation of the second lock part is prevented. In order to be able to rotate the second lock part, it is thus not sufficient for the lock element to be displaced from the first into the third position so that the primary end disengages from the first receiving means, but nor may it be displaced such that its secondary end is brought into engagement with the second receiving means. This design makes forcing of the arrangement more difficult.

According to one embodiment, each lock element in the first group presents a secondary end having the same extent as the secondary end of a lock element in the second group. Furthermore, the primary end of each lock element in the first group may have the same extent as the primary end of a lock element in the second group.

This allows the arrangement to be constructed with lock elements of uniform configuration, in which each lock element can be given a function corresponding to that of a lock element in the first group or a function corresponding to that of a lock element in the second group, quite simply by turning the primary end of the lock element in the first or the second direction.

If the lock elements are removably arranged in the second lock part, resetting of a lock code or opening criterion by the removal and turning of lock elements is also made possible.

According to one embodiment, the first receiving means comprises a first groove in the first lock part, arranged to receive the primary ends of the lock elements in the first group and the secondary ends of the lock elements in the second group. Effective cooperation between the lock elements and the first lock part can thus be realized with a simple configuration of the first lock part. The first groove may be common to all lock elements. In addition, the second receiving means may comprise a second groove arranged to receive the primary ends of the lock elements in the second group. The second groove may further be arranged to receive the secondary ends of the lock elements in the first group.

According to one embodiment, the arrangement is arranged such that the primary end of each lock element in the first group extends into the first groove when the lock element is in the first position and when the lock element is in the second position.

According to one embodiment, the arrangement is arranged such that the primary end of each lock element in the first group, upon displacement of the lock element from the second position into the third position, vacates the first groove.

According to one embodiment, each lock element in the second group presents a secondary end, the arrangement being arranged such that the secondary end extends into the first groove when the lock element is in the first position.

According to one embodiment, the arrangement is arranged such that the secondary end of each lock element in the second group, upon displacement of the lock element from the first position into the second position, vacates the first groove.

According to one embodiment, the arrangement is arranged such that the primary end of the lock element of the second group, upon displacement of the lock element from the second position into the third position, enters into the second groove.

According to one embodiment, the first groove presents a portion having a cross-sectional shape of decreasing width in a direction away from the bottom of the groove. Such a shape can make knocking of the lock more difficult. By knocking is meant a process by which a tool is inserted into the second lock part, after which one or more blows are applied to the tool in order thereby to force the elements to assume a non-blocking position. Knocking is prevented particularly effectively if the primary end of each lock element in the first group and the secondary end of each lock element in the second group present a portion of increasing width in a direction towards the primary end and the secondary end respectively.

According to one embodiment, the first groove comprises a wall portion which at least partially delimits the first groove in the longitudinal direction thereof. This makes accessing, and thus manipulation of the ends of the elements present in the first groove more difficult. The arrangement may further comprise a plurality of such wall portions arranged one after another in the first groove in order to make manipulation yet more difficult.

According to one embodiment, the arrangement comprises means for returning the lock elements to their first positions. This can be realized, for example, by arranging magnets in connection with the first receiving means and by making the lock elements of a magnetic material. If the first receiving means comprises a first groove, magnets may be arranged in the first groove. If the first groove comprises a wall portion, the wall portion may be made of a magnetic material. Regardless of how the return is achieved, the return means prevent the lock elements from sticking in their second or third positions, for example after a key has been removed from the arrangement, and may instead be brought effectively into engagement with the first receiving means when the position of the second lock part relative to the first receiving means so allows. It also makes it possible for the lock elements to assume their first positions without the aid of gravity, which can be useful, for example, when the arrangement is used in an application in which the first and second receiving means are at the same level.

According to one embodiment, the arrangement further comprises at least one element of a third element group arranged in the second lock part for cooperation with the first lock part and the key, which at least one element is arranged to assume a first position in the event of non-actuation of the key and to be movable by means of the key from the first position into a second position and a third position, the at least one element being arranged to prevent rotation of the second lock part in the first position and to allow rotation of the second lock part in the second and third position. Furthermore, the at least one element may present a primary end, and the arrangement may be arranged such that the primary end, when the at least one element is in the first position, engages with the first receiving means, wherein rotation of the second lock part is prevented, and further arranged such that the primary end disengages from the first receiving means when the at least one element is transported into the second or third position, wherein rotation of the second lock part is allowed. This type of element enables the arrangement to be coded such that a number of different keys may be used for opening. This type of element can thus be said to have a neutral function. These neutral elements also have the advantage that they prevent rotation of the second lock part when they are in their first position. The introduction of neutral elements does not therefore weaken the arrangement, but rather, like the lock elements in the first and second group, can help to prevent forced rotation of the second lock part.

BRIEF DESCRIPTION OF THE DRAWINGS

The present inventive concept will be further described below with reference to the accompanying drawings, which show non-limiting examples of embodiments of aspects of the inventive concept.

DETAILED DESCRIPTION OF PREFERRED EMBODIMENTS

Figure 1:
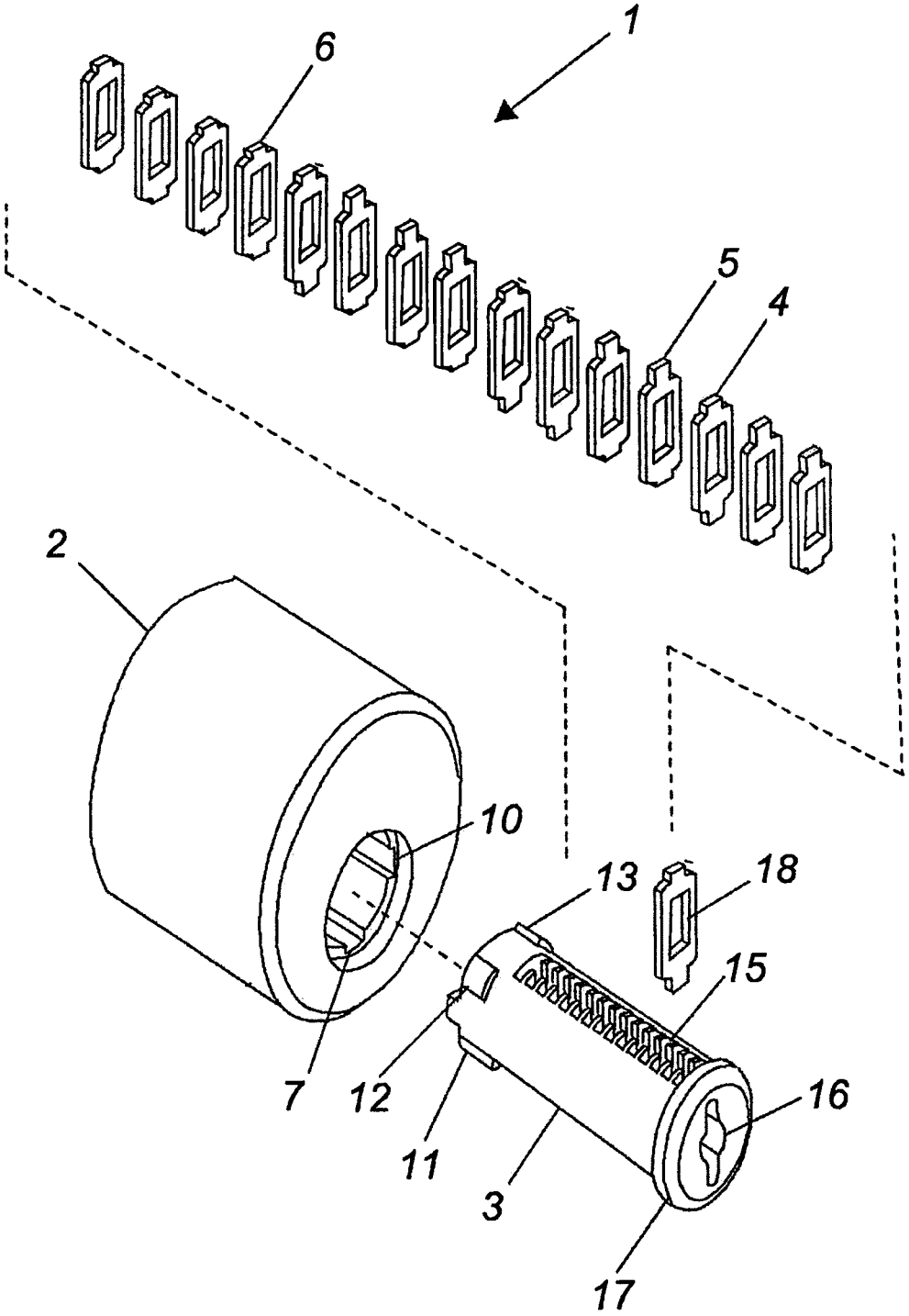
FIG. 1 is an exploded view of an arrangement according to one embodiment.

FIG. 1 is an exploded view of an arrangement 1 for a lock, with the constituent components shown schematically. The arrangement 1 comprises a first lock part 2 and a second lock part 3. The first lock part 2 comprises a through hole for receiving the second lock part 3. The second lock part 3 is arranged for rotatable mounting in the first lock part 2. The arrangement 1 further comprises a first group of lock elements, hereinafter represented by the lock element 4, and a second group of lock elements, hereinafter represented by the lock element 5. The arrangement 1 may further comprise one or more elements 6, hereinafter referred to as neutral elements 6. The elements 4, 5, 6 have different functions, which will be described in detail below.

The first lock part 2 comprises four receiving means in the form of grooves 7, 8, 9, 10 (of which only grooves 7 and 10 are visible in FIG. 1). The grooves 7, 8, 9, 10 extend in the longitudinal direction of the first lock part 2. In FIG. 1, the grooves 7, 8, 9, 10 are shown only schematically, but their detailed configuration will become apparent below. The second lock part 3 comprises four corresponding protrusions 11, 12, 13, 14 (of which only protrusions 11, 12, 13 are visible in FIG. 1). The protrusions 11, 12, 13, 14 are arranged on the rear portion of the second lock part 3. By orienting the second lock part 3 such that the protrusions 11, 12, 13, 14 are aligned with the grooves 7, 8, 9, 10, it is possible to insert the second lock part 3 into the first lock part 2 with the protrusions 11, 12, 13, 14 running in a corresponding groove 7, 8, 9, 10. A flange 17 is arranged on the front portion of the second lock part 3. The length of the first lock part 2 corresponds to the distance between one of the protrusions 11, 12, 13, 14 and the flange 17. Once the second lock part 3 has been inserted in the first lock part 2 such that the flange 17 touches the first lock part 2, the protrusions 11, 12, 13, 14 will thus have left the grooves 7, 8, 9, 10. By then rotating the second lock part 3 such that the protrusions 11, 12, 13, 14 become not aligned with the grooves 7, 8, 9, 10, it is possible to secure the second lock part 3 in the first lock part 2. With the four grooves 7, 8, 9, 10 and the four protrusions 11, 12, 13, 14, a firm fastening of the second lock part 3 in the first lock part 2 is enabled, while rotation of the second lock part 3 relative to the first lock part is nevertheless allowed. It is also possible to use fewer grooves and protrusions (for example 2-3) or more grooves and protrusions.

The second lock part 3 comprises a plurality of element channels 15, in which the elements 4, 5, 6 may be arranged. The element channels 15 extend at right angles to the rotational axis of the second lock part 3. The elements 4, 5, 6 are transportable in their respective element channels 15.

The front side of the second lock part 3 is provided with a keyhole 16 to allow insertion of a key into the second lock part 3.

Each element 4, 5, 6 comprises an opening 18. Once the elements 4, 5, 6 are arranged in the element channels 15, the openings 18 thus form together with the keyhole 16 a channel for the reception of a key. The upper edge of the opening 18 of each element 4, 5, 6 constitutes an engagement surface for the key.

The arrangement 1 is intended for mounting in a lock casing or lock housing, for example, in a door. In order to cooperate with other components in the lock casing (such as a lock bolt), the back of the second lock part 3 may for this purpose be provided with suitable means (not shown).

Figures 2A, 2B, 2C:
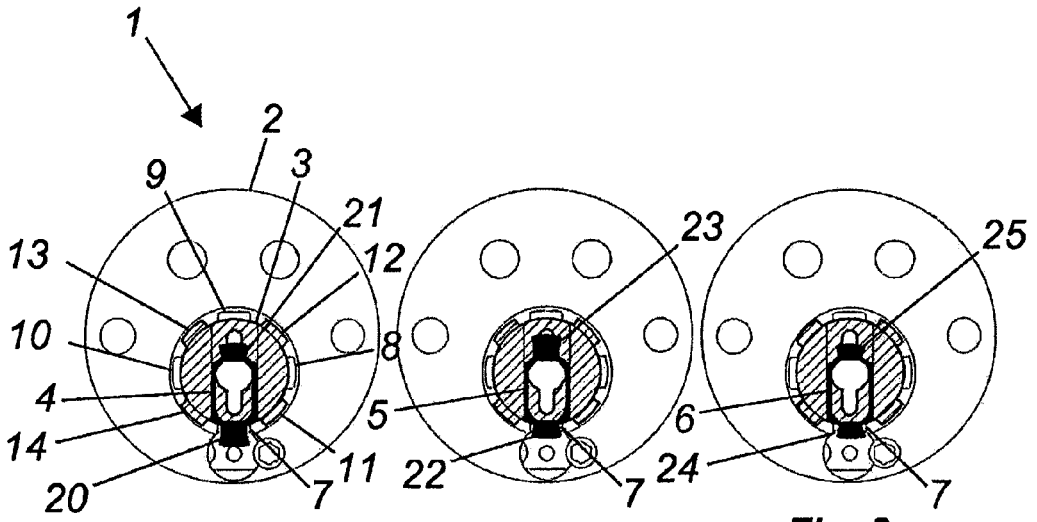
FIGS. 2*a-c* illustrate lock elements in a first and second group of lock elements, as well as a neutral element, in their respective first positions.

FIGS. 2*a-c* show three views of the arrangement 1 viewed from the rear, in which rear pieces of the second lock part 3 have been removed with the aim of revealing the different elements 4, 5, 6 in place in the second lock part 3 and illustrating the different functions of the elements 4, 5, 6. In order to facilitate understanding of the embodiment, the protrusions 11, 12, 13, 14 of the second lock part, and their orientation relative to the grooves 7, 8, 9, 10 of the first lock part 2, are also shown. In FIG. 2*a*, the lock element 4 can be seen. In FIG. 2*b*, the lock element 5 can be seen. In FIG. 2*c*, one of the neutral elements 6 can be seen. In FIGS. 2*a-c*, the second lock part 3 is oriented such that its element channels 15 extend between the radially opposing grooves 7 and 9, hereinafter referred to as "the first groove" and "the second groove" respectively. The elements 4, 5, 6 are in a respective initial position, hereinafter referred to as "the first position", and no key is inserted in the second lock part 3. The second lock part 3 is in an initial orientation relative to the first lock part 2.

As can be seen from FIGS. 2*a-c*, the first groove 7 may have a radially inner part and a radially outer part of circular cross section, which outer part comprises a partition. This will be described in more detail in connection with FIGS. 8-9.

With reference to FIG. 2*a*, the lock element 4 presents a first end 20, hereinafter referred to as "the primary end 20", and a second end 21, hereinafter referred to as "the secondary end 21". When the lock element 4 is in its first position, the primary end 20 extends into the first groove 7. When the lock element 4 is in the first position, it thus prevents rotation of the second lock part 3 relative to the first lock part 2. The first groove 7 has a depth such that it can receive the whole of the primary end 20.

With reference to FIG. 2*b*, the lock element 5 presents a second end 22, hereinafter referred to as "the secondary end 22", and a first end 23, hereinafter referred to as "the primary end 23". When the lock element 5 is in its first position, the secondary end 22 extends into the first groove 7. When the lock element 5 is in the first position, it thus prevents rotation of the second lock part 3 relative to the first lock part 2.

With reference to FIG. 2*c*, the neutral element 6 has a first end 24 and a second end 25. When the neutral element 6 is in its first position, the first end 24 extends into the first groove 7. When the neutral element 6 is in the first position, it thus prevents rotation of the second lock part 3 relative to the first lock part 2. As can be seen from FIG. 2*c*, the first end 24 and the second end 25 may have the same shape. A neutral element 6 of this kind thus acquires the same function, regardless of whether the first end 24 or the second end 25 of the neutral element 6 is facing in the direction towards the first groove 7. Alternatively, a neutral element may be configured with a first and second end in which only the first end is arranged to cooperate with the first groove 7.

Since all elements present ends which extend into the first groove 7 when the elements are in their first positions, sight of and access to ends of elements situated behind these in the first groove 7 is prevented, which, in turn, makes manipulation of the arrangement difficult.

As can be seen from FIGS. 2*a* and *b*, the secondary end 21 of the lock element 4 has the same extent as the secondary end 22 of the lock element 5. The primary end 20 of the lock element 4 has the same extent as the primary end 23 of the lock element 5. The primary end 20 of the lock element 4 is facing in the opposite direction to the primary end 23 of the lock element 5. The lock element 4 can thus be reconfigured into a lock element of the same group as the lock element 5, i.e. the second group, by orienting the lock element 4 such that the primary end 20 of the lock element 4 is facing in the same direction as the primary end 23 of the lock element 5. The functionality of the lock elements of the first group and the lock elements of the second group can thus be obtained with just one lock element design.

According to an alternative embodiment, the secondary ends of the first group of lock elements do not need to have the same configuration as the secondary ends of the second group of lock elements. Correspondingly, nor do the primary ends of the first group of lock elements need to have the same extent as the primary ends of the second group of lock elements. Such a configuration of the lock elements may be used if the above reconfigurability is not desirable.

In FIG. 1, the element channels 15 have an open configuration which enables simple withdrawal of the elements 4, 5, 6 from the second lock part 3 and reorientation of the elements 4, 5, 6. This, in turn, enables comfortable and easy resetting of the lock code, even after the arrangement has been delivered to an end user. According to an alternative embodiment, the second lock part 3 may be arranged such that this simple withdrawal is prevented, for example by arranging some form of cover plates over the element channels 15.

According to the embodiment illustrated in FIGS. 1-2, the first receiving means and the second receiving means are configured as a first groove 7 and a second groove 9 respectively. According to an alternative embodiment, the first receiving means may instead comprise a first recess arranged on the inner side of the first lock part 2 and the second receiving means may comprise a corresponding second recess arranged on the inner side of the first lock part 2 directly opposite the first recess. Such a pair of recesses may further be provided for each element 4, 5, 6 in the second lock part 3.

Figures 3A, 3B, 3C:
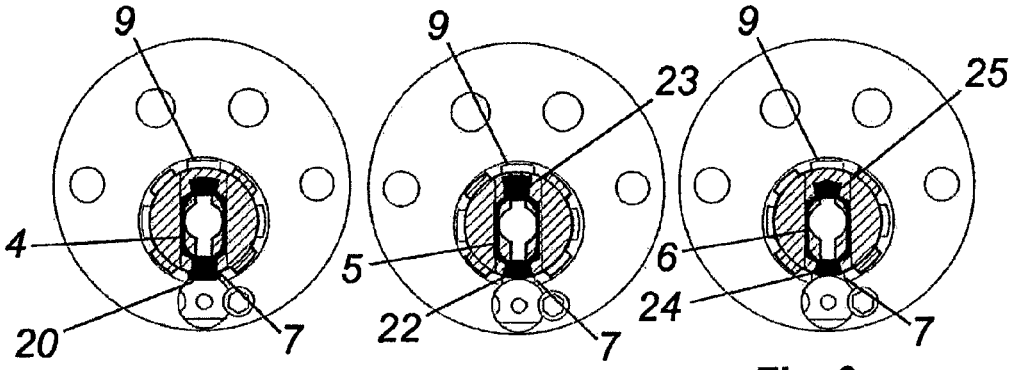
FIGS. 3*a-c* illustrate lock elements in a first and second group of lock elements, as well as a neutral element, in their respective second positions.

FIGS. 3*a-c* show the arrangement 1 in the same way as in FIGS. 2*a-c*, but in which each of the elements 4, 5, 6 has been transported by a uniform distance D1 in the respective element channel 15 from its first position into a second position by means of a key (not shown in order to give greater clarity).

As is shown in FIG. 3*a*, the primary end 20 of the lock element 4 extends into the first groove 7 also when the lock element 4 is in its second position. When the lock element 4 is in the second position, it thus prevents rotation of the second lock part 3 relative to the first lock part 2. As can be seen from FIG. 3*a*, the lock element 4 needs to be moved a further distance from its second position into a third position in order for its primary end 20 to fully vacate the first groove 7.

As is shown in FIG. 3*b*, the secondary end 22 of the lock element 5 vacates the first groove 7 when the lock element 5 is displaced from its first position into its second position. The lock element 5 further presents an extent such that the primary and the secondary end 22, 23 of the lock element 5 do not extend into the first or second groove 7, 9 when the lock element 4 is in the second position. The lock element 5 thus allows rotation of the second lock part 3 relative to the first lock part 2 when the lock element 5 is in the second position. If, on the other hand, the lock element 5 is moved a further distance from its second position into a third position, then the primary end 22 of the lock element 5 enters into the second groove 9, wherein rotation of the second lock part 3 relative to the first lock part 2 is prevented.

As is shown in FIG. 3*c*, the first end 24 of the neutral element 6 vacates the first groove 7 when the neutral element 6 is displaced from its first position into its second position. When the neutral element 6 is in the second position, it thus does not prevent rotation of the second lock part 3 relative to the first lock part 2.

As can be seen from FIG. 3*c*, the neutral element 6 presents an extent such that its first and second end 24, 25 do not extend into the first or second groove 7, 9 when the lock element 4 is in the second position. It is also evident that the neutral element 6 has an extent such that it can be moved a further distance from its second position into a third position without its second end 25 entering into the second groove 9. The neutral element 6 thus does not prevent rotation of the second lock part 3 relative to the first lock part 2, neither when it is in the second nor in the third position. An arrangement having neutral elements 6 thus enables keys of different configuration to be used to rotate the second lock part 3.

Figures 4A, 4B, 4C:
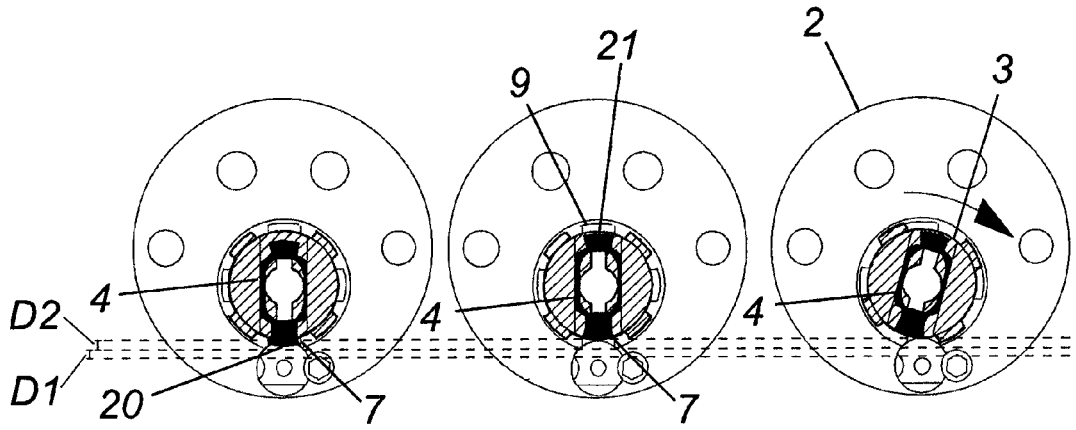
FIGS. 4*a-c*, 5*a-c* and 6*a-c* illustrate the function of the various elements.

FIGS. 4*a-c* illustrate the function of the lock element 4 in further detail:

In FIG. 4*a*, the lock element 4 is in its second position at the distance D1 from its first position. The primary end 20 of the lock element 4 extends into the first groove 7, wherein rotation of the second lock part 3 relative to the first lock part 2 is prevented. In FIG. 4*b*, the lock element 4 is in its third position, at a distance D1+D2 from its first position, the primary end 20 having vacated the first groove 7. The lock element 4 has been transported into the third position from the first position via the intermediate second position. The lock element 4 has an extent such that the lock element 4 does not extend into the first or second groove 7, 9 when the lock element 4 is in the third position. The lock element 4 thus no longer prevents rotation of the second lock part 3 relative to the first lock part 2, as is illustrated in FIG. 4*c*, in which the second lock part 3 is rotated together with the lock element 4. Should the lock element 4 in FIG. 4*b* be moved further to a fourth position such that its secondary end 21 enters into the second groove 9, then the lock element 4 again prevents rotation of the second lock part 3.

Figures 5A, 5B, 5C:
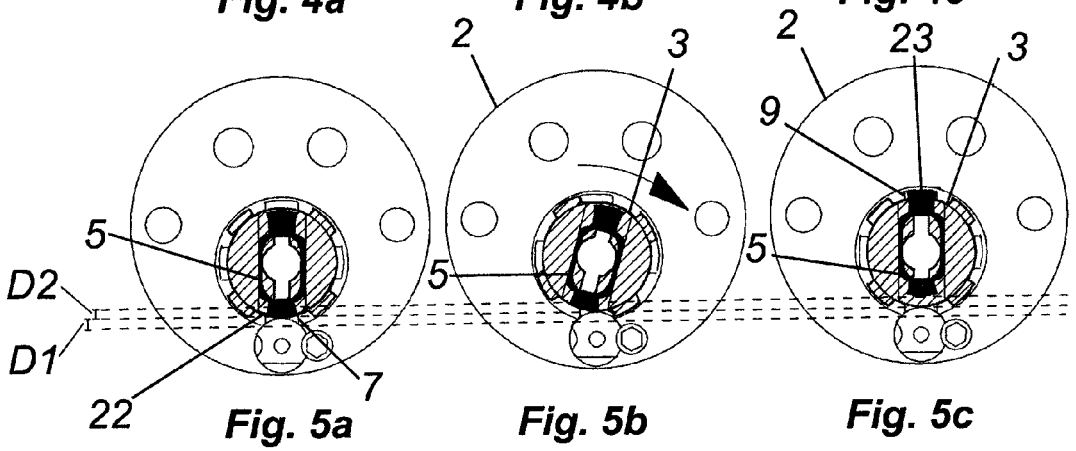

FIGS. 5*a-c* illustrate the function of the lock element 5 in further detail:

In FIG. 5*a*, the lock element 5 has been displaced by the distance D1 from its first position into its second position, the secondary end 22 of the lock element 5 having vacated the first groove 7. The lock element 5 thus does not prevent rotation of the second lock part 3 relative to the first lock part 2, as is illustrated in FIG. 5*b*, in which the second lock part 3 is rotated together with the lock element 5. In FIG. 5*c*, the lock element 4 has been displaced by a distance D1+D2 from the first position into its third position via the intermediate second position, the primary end 23 extending into the second groove 9. The lock element thus prevents rotation of the second lock part 3 relative to the first lock part 2.

Figures 6A, 6B, 6C:
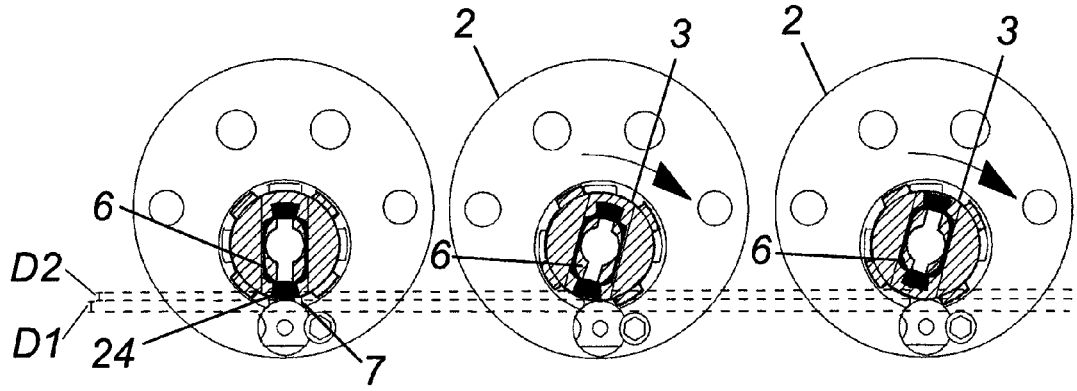

FIGS. 6*a-c* illustrate the function of the neutral element 6 in further detail:

In FIG. 6*a*, the neutral element 6 has been displaced by the distance D1 from its first position into its second position, the first end 24 of the neutral element 6 having vacated the first groove 7. The neutral element 6 thus does not prevent rotation of the second lock part 3 relative to the first lock part 2, as is illustrated in FIG. 6*b*, in which the second lock part 3 is rotated together with the neutral element 6. As has been described above, the neutral element 6 may be moved a further distance D2 from its second position into its third position without the neutral element 6 preventing rotation of the second lock part 3 relative to the first lock part 2. This is illustrated in FIG. 6*c*.

Rotation of the second lock part 3 is allowed if all lock elements in the first group 4 are brought into their third position and all lock elements in the second group 5 are brought into their second position, and all neutral elements 6 are brought into their second or third position. By varying the number of elements 4, 5, 6 and the relative order of the elements 4, 5, 6, different opening criteria, or lock codes, can be obtained. The arrangement 1 comprises sixteen elements 4, 5, 6 and element channels 15. An arrangement having a larger number of elements 4, 5, 6 and element channels 15 enables more lock codes. Correspondingly, an arrangement having a smaller number of elements 4, 5, 6 enables fewer lock codes.

As can be seen from FIGS. 2-6, the distances between the respective first and second positions of the elements 4, 5, 6 may be equally large. Furthermore, the distances between the respective second and third positions of the elements 4, 5, 6 may be equally large. It is also evident that the first, second and third positions may thus be equal for the different elements 4, 5, 6 insofar as the engagement surfaces of the elements 4, 5, 6 are at the same level in their respective first, second and third positions. Rotation of the second lock part 3 is thus allowed if the lock elements of the first group are transported by the distance D1+D2 from their first positions, and if the lock elements of the second group are transported by the distance D1 from their first positions, and if any neutral elements 6 are transported by the distance D1 or D1+D2 from their first positions.

Figure 7A:
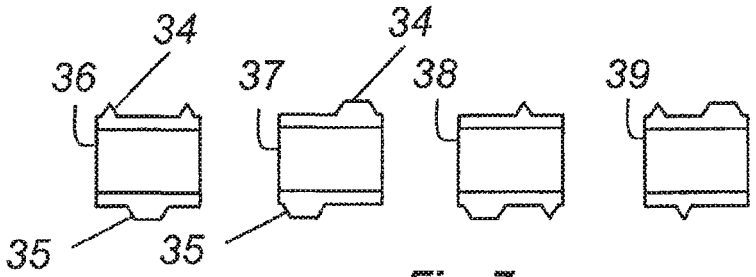
FIG. 7*a-c* illustrates a key which may be used together with the arrangement.
Figure 7B:
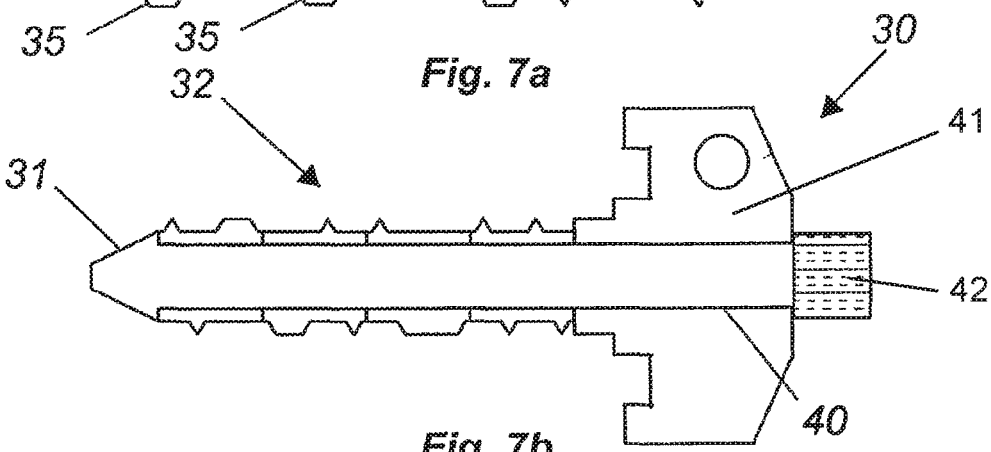
Figure 7C:
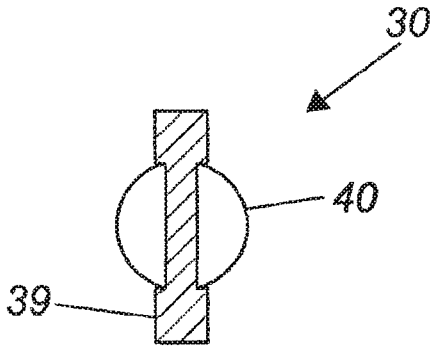

In FIGS. 7*a-c* is shown a key 30 which can be used in combination with the arrangement 1. The key 30 comprises a front end 31 of gradually increasing height. The end 31 has an ultimate height such that the elements 4, 5, 6, when the key is inserted into the second lock part 3, are transported from their respective first positions into their respective second positions, i.e. they have been displaced by the distance D1 from their first positions.

The key 30 further comprises a coded portion 32. If the key is correctly coded with respect to the arrangement 1, the coded portion 32 has a protrusion 34 at each position along the key 30 which corresponds to positions for a lock element in the first group 4. This protrusion 34 has an extent corresponding to the distance D2 between the second and third position for the lock element 4 in the first group. Conversely, the coded portion 32 does not have any protrusion at the positions along the key 30 which correspond to positions for lock elements in the second group 5. At the positions along the key 30 which correspond to positions for neutral elements 6, the coded portion 32 may either present a protrusion or not present any protrusion, without this affecting the facility to rotate the second lock part 3. This is a consequence of the fact that a neutral element 6 allows rotation both when in its second position and when in its third position.

The profile of the coded portion 32 may thus be easily described with a binary code, for example by having "1" correspond to the presence of a protrusion and "0" correspond to the lack of a protrusion. In the same way, the corresponding configuration of lock elements 4, 5 (i.e. the lock code) can also easily be described with a binary code.

A key intended for the arrangement 1 thus comprises a plurality of successive key positions, the key being arranged to displace the elements 4, 5, 6 from their respective first positions into their respective second positions as it is inserted into the arrangement, and wherein the key, at each key position, is arranged to cooperate with an element 4, 5, 6 so that this element assumes its second position or third position.

To prevent a lock element 5 from sticking in its third position as the key 30 is inserted, the coded portion 32, at the positions corresponding to positions for lock elements in the second group 5, may present a protrusion 35, as is shown in FIG. 7*a*. This protrusion 35 has an extent which is equal in size to the extent of the protrusion 34. The key 30 thus acquires a double profile such that, at each position along the coded profile 32 corresponding to the position for an element 4, 5, 6, it has either a protrusion 34 on the top side or a protrusion 35 on the bottom side.

As is illustrated in FIG. 7*a*, the coded portion 32 may be made up of a plurality of code segments 36, . . . , 39. Each code segment 36, . . . , 39 corresponds to four elements 4, 5, 6. Other code segment lengths are also possible, however, such as 1 to 3 elements or more than 4 elements. The key 30 comprises a rod 40, which has a central groove extending from one end of the rod 40 to the opposite end of the rod 40. The code segments 36, . . . , 39 may be arranged in grooves of the rod 40. In FIG. 7*c*, a cross section of the rod 40 and of a code segment 39 is shown.

The key 30 further comprises a grip 41. The grip 41 is arranged in the groove of the rod 40. The grip 41 and the code segments 36, . . . , 39 can be locked in place along the rod by means of a nut 42. The key 30 may thus be constructed by means of just a limited number of code segments, which may be configured in a standardized manner. This, in turn, enables rational production of code segments, for example by casting or injection moulding of metal or composite material, since just one set of moulds needs to be built. It is also possible, however, to configure the key 30 such that it cannot be constructed. For example, the key 30 can be formed in a single piece by a casting or milling process.

Possible groove configurations will be discussed below in connection with the first groove 7, but the other grooves 8, 9, 10 may also be configured correspondingly.

Figure 8A:
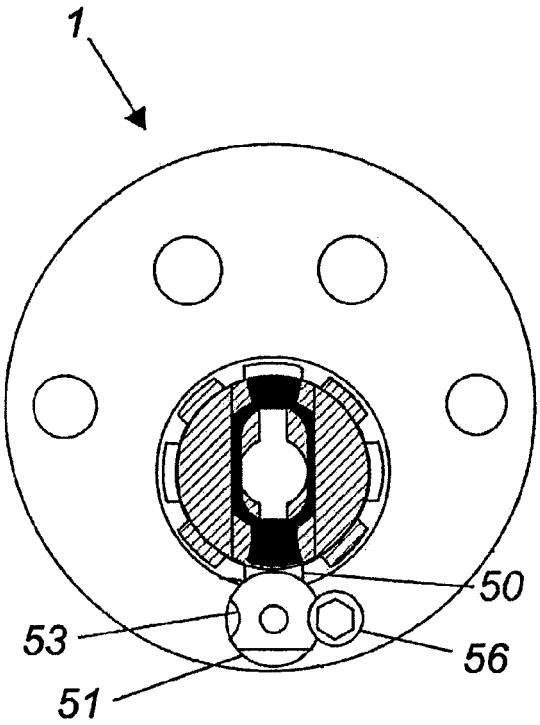
FIGS. 8*a-b* and 9*a-b* illustrate a wall arrangement arranged in a first groove in the first lock part.
Figure 8B:
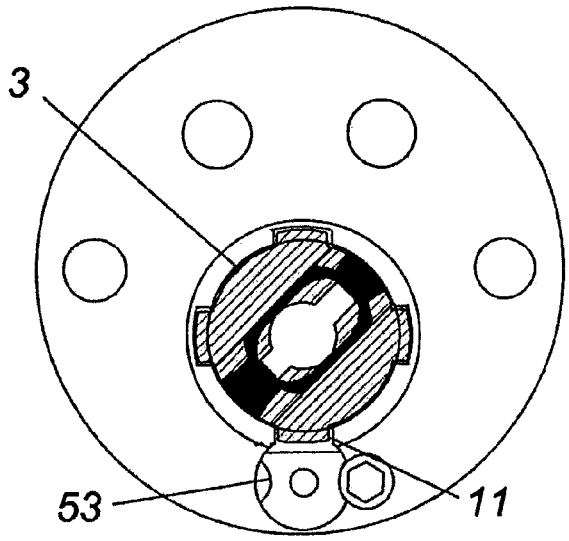
Figure 9A:
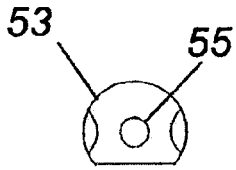
Figure 9B:
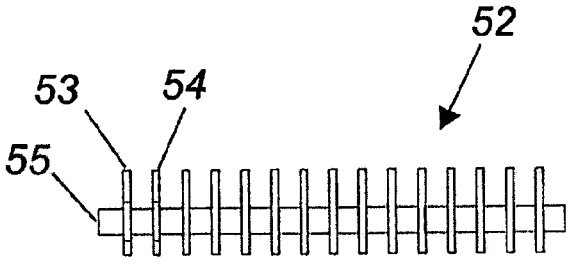

FIGS. 8*a*-*b* illustrate the arrangement 1 in the same way as FIGS. 2-6. As can be seen from FIG. 8*a*, the first groove 7 may comprise a radially inner part 50 and a cylindrical and radially outer part 51. The first groove 7 thus presents a portion having a cross-sectional shape of decreasing width in a direction away from the bottom of the groove 7. This configuration makes forcing of the lock by means of knocking difficult. By configuring the primary end 20 of the lock element 4 and the secondary end 22 of the lock element 5 with a portion of increasing width in a direction towards the primary end 20 and the secondary end 22 respectively, forcing of the arrangement 1 by means of knocking is made more difficult.

In order to make forcing of the arrangement 1 yet more difficult, the first groove 7 may be delimited in its longitudinal direction so as thereby to make access to the ends of the elements 4, 5, 6 difficult. For this purpose, the outer part 51 accommodates a wall arrangement 52 shown from the rear in FIG. 9*a* and from the side in FIG. 9*b*. The wall arrangement 52 comprises a plurality of wall portions 53, 54, etc. arranged along a rod 55. The wall portions 53, 54 and the outer part 51 are configured such that the wall arrangement 52 can be mounted by being inserted into the outer part 51 of the first groove 7. The wall arrangement 52 may be fastened in the first lock part 2, for example by means of a screw 56 which can engage in the rounded recesses of the wall portions 53, 54.

In FIG. 8*a*, the rearmost wall portion 53 is visible. The wall portions 53, 54 delimit the first groove 7 and make access to the ends 20, 22, 24 of the elements 4, 5, 6 present in the first channel 7 difficult. This makes manipulation of the arrangement 1 difficult should an unauthorized person, for example, manage to drill holes on the flange 17 in order to gain access to the first groove 7.

In FIG. 8*a*, the wall arrangement 52 is oriented such that its wall portions 53, 54 extend into the inner part 50 of the first groove 7. The wall portions 53, 54 thus stop any of the protrusions 11, 12, 13, 14 of the second lock part 3 from being transported through the first channel 7. Consequently, the wall portions 53, 54 prevent the second lock part 3 from being disassembled from the first lock part 2 from the front side of the arrangement 1.

By instead orienting the wall arrangement 52 according to FIG. 8*b*, it is possible to transport the protrusions 11, 12, 13, 14 of the second lock part 3 freely through the first channel 7. This orientation thus allows the second lock part 3 to be disassembled from the first lock part 2 from the front side of the arrangement 1 by rotation of the second lock part 3 with a correctly coded key.

In FIGS. 8 and 9, the outer part 51 and the wall portions 53, 54 have partially circular cross sections. Other shapes are also possible, however, for example triangular or rectangular cross sections.

Figure 10:
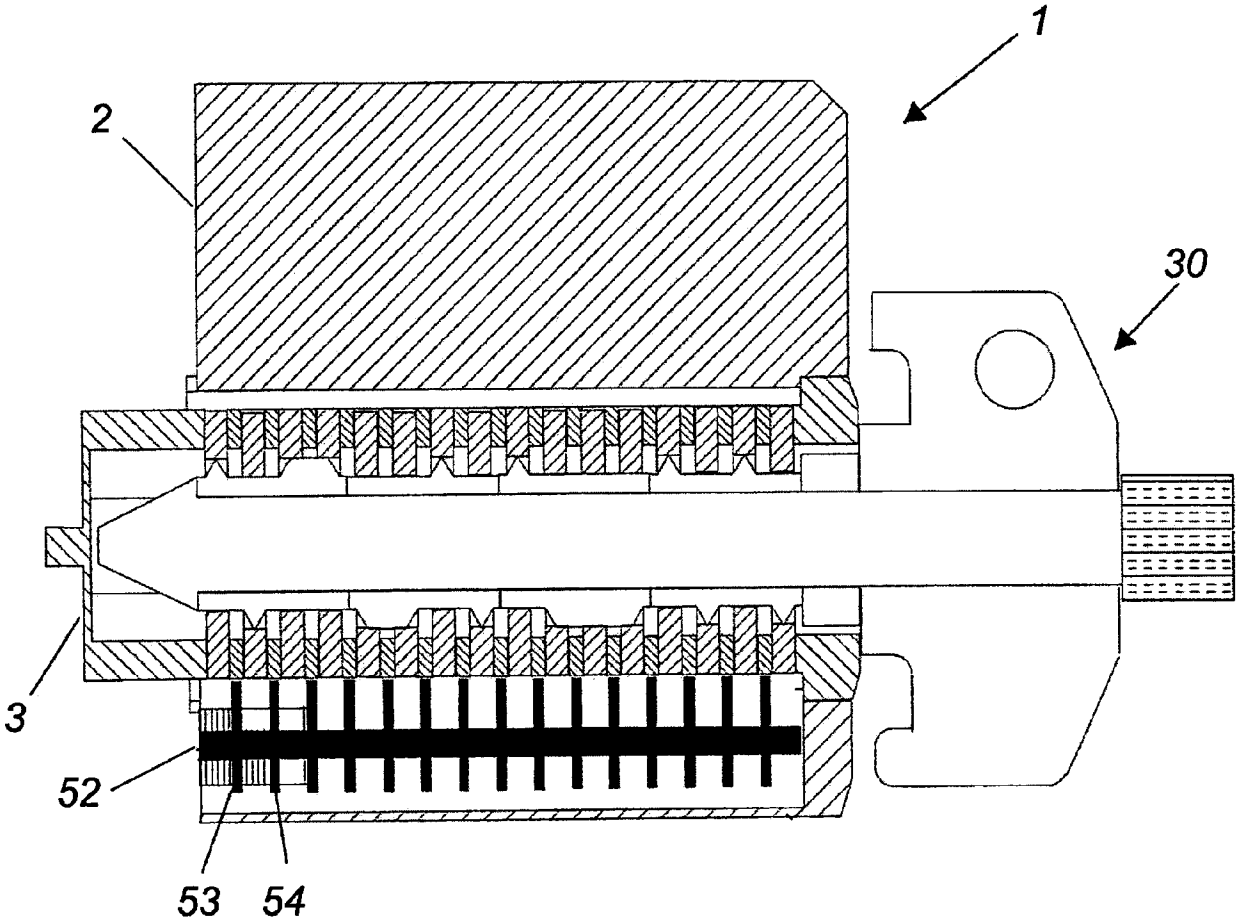
FIG. 10 illustrates the arrangement and an associated key from the side.

FIG. 10 is a side view of the arrangement 1 with a correctly coded key 30 inserted in the second lock part 3, wherein rotation of the second lock part 3 is possible.

In FIGS. 1-6 and 8-10, the arrangement 1 is shown in a vertical orientation with the first groove 7 and the second groove 9, as vertically opposite grooves with the first groove 7 at the lower level. The arrangement 1 is not limited to use in this orientation, however, but can be used in any chosen orientation. Furthermore, the first positions of the elements 4, 5, 6 have been described with respect to the first groove 7. It is also possible, however, to configure the other grooves 8, 9, 10 correspondingly, the elements 4, 5, 6 being able to assume their first positions also with respect to the grooves 8, 9, 10. This enables the second lock part 3 to be locked in further rotational positions, which increases the flexibility of the arrangement 1.

According to one embodiment, the first groove 7 comprises magnets. If the first groove comprises a wall arrangement 52, the wall portions 53, 54 thereof, for example, may be permanent magnets. Furthermore, the elements 4, 5, 6 may at least partially be made of a magnetic material, in which case an action of returning the elements 4, 5, 6 to their respective first positions may be realized. This element-returning action is particularly advantageous if the arrangement 1 is to be used in a different orientation from that shown in FIGS. 1-6 and 8-10, for example in a wholly horizontal orientation in which gravitational force cannot induce the elements 4, 5, 6 to return to their respective first positions after a key has been removed from the second lock part 3.

FIG. 11 illustrates a configuration of receiving means of a first lock part 60 according to an alternative embodiment, which can be used together with a second lock part of the same type as the previously described second lock part 3.

Figure 11A:
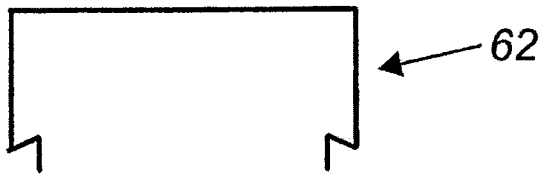
FIGS. 11*a*-c show a first lock part according to an alternative embodiment.
Figure 11B:
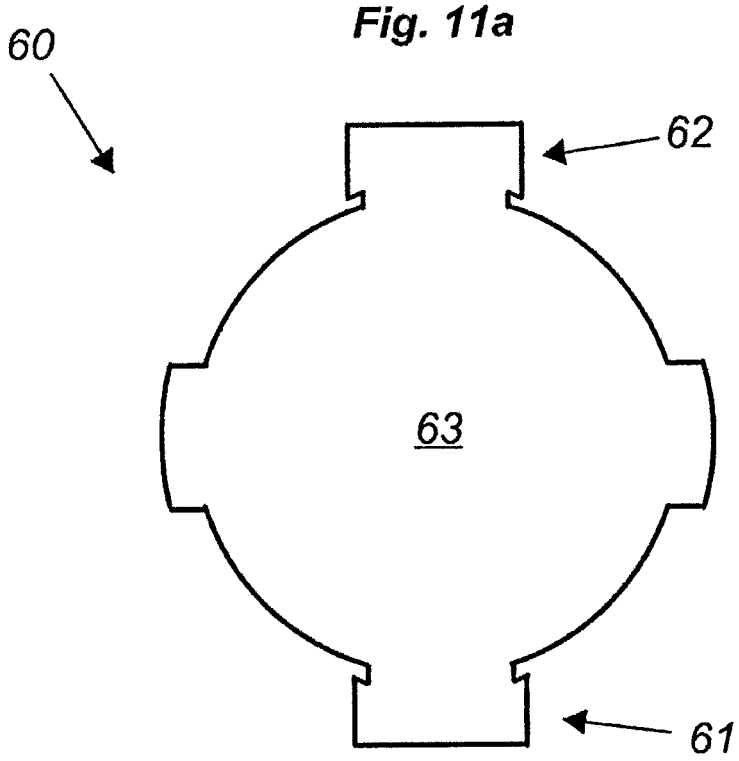

FIG. 11*b* shows an inner profile of a cross section of the first lock part 60. The profile defines an opening 63 for the reception of the second lock part. The first lock part 60 comprises a first receiving means 61 configured as a groove which extends in the longitudinal direction of the first lock part and is common to all lock- and neutral elements of a second lock part. Alternatively, the first receiving means 61 may comprise a recess individually designed for each lock- and neutral element and having the profile shown in FIG. 11*b*.

Figure 11C:
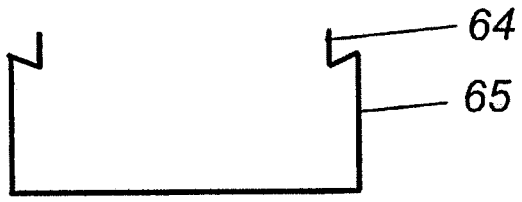

FIG. 11*c* shows an enlarged view of the first groove 61. The groove 61 has an inner portion 64 and an outer portion 65. The inner portion 64 opens out into the opening 63. The outer portion 65 has a greater width than the inner portion 64. The groove 61 thus presents an overhang.

Figure 12:
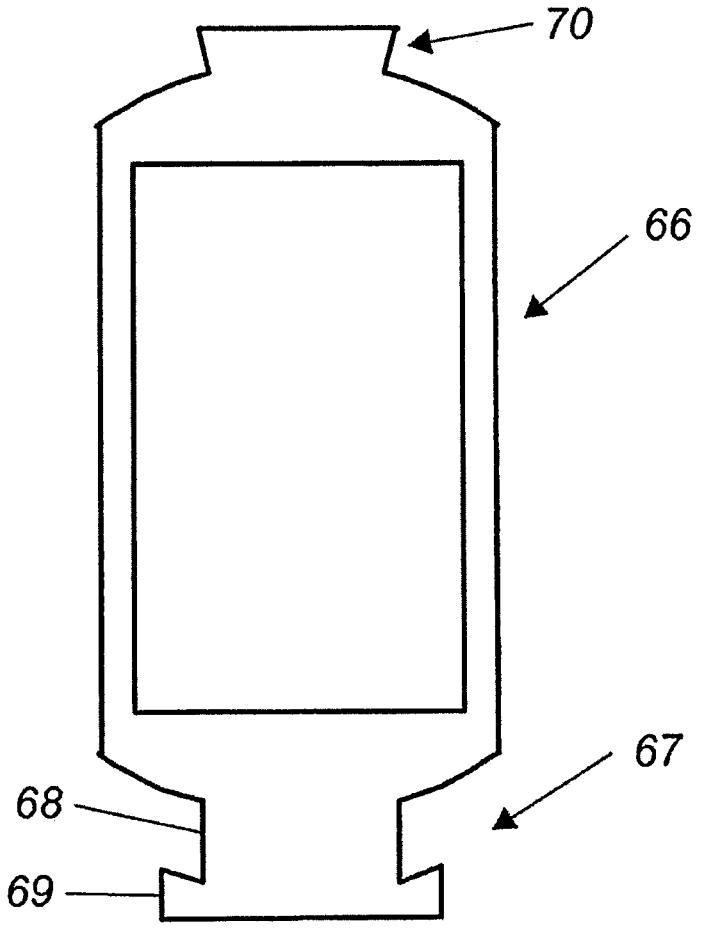
FIG. 12 shows a lock element according to an alternative embodiment.

FIG. 12 shows a lock element 66 having a function corresponding to the function of the lock element 4 in the previously described first group. As is shown in FIG. 12, the primary end 67 of the lock element 66 may be arranged to provide a hook effect between the overhang of the groove 61 and the primary end 67. This configuration makes forcing of the lock by means of knocking when the lock element 66 is in its first position difficult. It also makes forced rotation of the second lock part difficult, since the primary end 67 may then hook on the groove 61. More specifically, the primary end 67 has a waist portion 68 and a protrusion 69. The protrusion 69 has a greater width than the waist portion 68. The width of the protrusion 69 does not exceed the width of the inner portion 64 of the groove 61. The width of the protrusion 69 is thus such that insertion of the primary end 67 into the groove 61 is allowed.

As is shown in FIG. 11*b*, the overhang may be undercut. As is shown in FIG. 12, the protrusion 69 may also be undercut. This can further reinforce the hook effect between the primary end 67 and the groove 61.

As is shown in FIGS. 11*a* and 11*b*, the first lock part 60 may further comprise a second receiving means 62, opposite to the first receiving means 61. The second receiving means 62, like the first receiving means 61, may be configured as a groove, alternatively as a plurality of recesses as described above for the first receiving means 61. The lock element 66 may further comprise a secondary end 70 presenting a width which increases in a direction towards the secondary end. As previously described in connection with lock elements 4 and 5, it is possible to give the lock element 66 a function corresponding to the function of the lock element 5 by turning the lock element 66 such that its secondary end 70 is turned towards the groove 61.

Where such reconfigurability is not desirable, it will be appreciated that a lock element having a function corresponding to that of the previously described lock element 5 may alternatively be obtained with a lock element comprising a primary end for cooperation with the groove 61, which primary end has the same configuration as the secondary end 70.

The groove 61 and/or the groove 62 may further be delimited in their respective longitudinal directions as with the embodiment shown in FIGS. 8-9.

In the above-described embodiments the first lock part 2 is configured in one piece. According to an alternative embodiment, the first lock part may be divided into two or more pieces. When a second lock part (corresponding to the lock part 3 in FIG. 1) is mounted in the first lock part, its pieces can be held together between a flange (corresponding to the flange 17 in FIG. 1) and protrusions (corresponding to the protrusions 11, 12, 13, 14 in FIG. 1) of the second lock part.

For example, a first piece of the first lock part may be arranged in a door and a second piece of the first lock part may be furnished in a behind-situated door frame. By inserting the second lock part in the first and second piece and subsequently rotating the second lock part such that the protrusions of the second lock part are not lined up with the grooves in the first and second piece and the elements of the second lock part cooperate with the first receiving means of the first and second piece, it is thus possible to lock the door easily. The door and the door frame may be held together between the flange and the protrusions of the second lock part. The door may further be unlocked by rotation of the second lock part such that withdrawal of the second lock part from the first and second pieces is allowed, wherein the second lock part may be removed and the door may be opened.

Above, the inventive concept has mainly been described with reference to a number of embodiments. As will be appreciated by the person skilled in the art, embodiments other than the above-described are possible, however, without deviating from the inventive concept as defined by the appended patent claims.

The invention claimed is:

1. An arrangement for a lock comprising:

a first lock part and a second lock part which is rotatably arranged in the first lock part and comprises a plurality of lock elements for cooperation with the first lock part and arranged to receive a key, which lock elements comprise a first and a second group of lock elements which are oriented with a primary end facing in a first and a second direction respectively relative to the second lock part, the first direction being different from the second direction, each of which lock elements in the first and second group is arranged:

to assume a first position relative to the second lock part in the absence of actuation of the key, to be movable by means of the key from the first position into a third position via a second intermediate position, and to prevent rotation of the second lock part in the first position, wherein each lock element in the first group is arranged to, in the second position, prevent rotation of the second lock part and, in the third position, allow rotation of the second lock part, and each lock element in the second group is arranged to, in the second position, allow rotation of the second lock part and, in the third position, prevent rotation of the second lock part.

2. An arrangement according to claim 1, wherein each lock element in the first group and the second group is reconfigurable into a lock element in the second group and the first group respectively by such reorientation of the lock element that the primary end thereof is turned in said second and first direction respectively.

3. An arrangement according to claim 1, wherein the first lock part comprises a first and a second receiving means, the first and second group of lock elements being arranged to cooperate with said first and second receiving means.

4. An arrangement according to claim 3, wherein the arrangement is arranged such that the primary end of each lock element in the first group engages with the first receiving means when said lock element is in the first position and when said lock element is in the second position, wherein rotation of the second lock part is prevented.

5. An arrangement according to claim 4, wherein the arrangement is arranged such that the primary end of each lock element in the first group, upon displacement of the said lock element from the second position into the third position, is disengaged from the first receiving means, wherein rotation of the second lock part is allowed.

6. An arrangement according to claim 3, wherein each lock element in the second group presents a secondary end, and wherein the arrangement is arranged such that said secondary ends engage with the first receiving means when said lock element is in the first position, wherein rotation of the second lock part is prevented.

7. An arrangement according to claim 6, wherein the arrangement is arranged such that the secondary end of each lock element in the second group, upon displacement of the lock element from the first position into the second position, is disengaged from the first receiving means, wherein rotation of the second lock part is allowed.

8. An arrangement according to claim 4, wherein the arrangement is arranged such that the primary end of each lock element in the second group, upon displacement of the lock element from the second position into the third position, is brought into engagement with the second receiving means, wherein rotation of the second lock part is prevented.

9. An arrangement according to claim 6, wherein each lock element in the first group presents a secondary end having the same extent as the secondary end of each lock element in the second group.

10. An arrangement according to claim 1, wherein the primary end of each lock element in the first group has the same extent as the primary end of each lock element in the second group.

11. An arrangement according to claim 6, wherein the first receiving means comprises a first groove in the first lock part, which first groove is arranged to receive the primary ends of the lock elements in the first group and the secondary ends of the lock elements in the second group.

12. An arrangement according to claim 11, wherein the first groove is shared by all lock elements.

13. An arrangement according to claim 12, wherein the first groove comprises a wall portion which at least partially covers the first groove in the longitudinal direction thereof.

14. An arrangement according to claim 12, wherein the first groove presents a portion having a cross-sectional shape of decreasing width in the direction away from the bottom of the first groove.

15. An arrangement according to claim 12, wherein the primary end of each lock element in the first group and the secondary end of each lock element in the second group present a portion of increasing width in the direction towards the primary end and the secondary end respectively.

16. An arrangement according to claim 3, further comprising at least one element of a third group arranged in the second lock part for cooperation with the first lock part and the key, which said at least one element is arranged to assume a first position in the event of non-actuation of the key and to be movable by means of the key from the first position into a second position and a third position, said at least one element being arranged to prevent rotation of the second lock part in the first position and to allow rotation of the second lock part in the second and third position.

17. An arrangement according to claim 16, wherein said at least one element presents a primary end, and the arrangement is arranged such that the primary end, when said at least one element is in the first position, engages with the first receiving means, wherein rotation of the second lock part is prevented, and is further arranged such that the primary end disengages from the first receiving means when said at least one element is transported into the second or third position, wherein rotation of the second lock part is allowed.

* * * * *